United States Patent [19]

Sullivan et al.

[11] Patent Number: 5,049,849

[45] Date of Patent: Sep. 17, 1991

[54] CIRCUIT BREAKER

[75] Inventors: Steven K. Sullivan, Cranston, R.I.; Richard L. Jenne, Attleboro, Mass.; Gennady Baskin, Providence, R.I.

[73] Assignee: Texas Instruments Incorporated, Dallas, Tex.

[21] Appl. No.: 575,461

[22] Filed: Aug. 30, 1990

[51] Int. Cl.[5] ..... H01H 31/00; H01H 61/00; H01H 85/00

[52] U.S. Cl. ..... 337/1; 337/13; 337/35; 361/104

[58] Field of Search ..... 337/1, 2, 3, 4, 5, 6, 337/7, 12, 13, 14, 16, 17, 27, 35, 101–107, 111, 373; 361/104

[56] References Cited

U.S. PATENT DOCUMENTS

| | | | |
|---|---|---|---|
| 2,202,621 | 5/1940 | Broune | 337/16 |
| 3,141,080 | 7/1964 | Ege | 337/111 |
| 3,143,614 | 8/1964 | Ege | 337/111 |
| 3,474,372 | 10/1969 | Davenport et al. | 337/1 |
| 4,780,698 | 8/1990 | Tomkinson et al. | 337/113 |

*Primary Examiner*—Harold Broome
*Attorney, Agent, or Firm*—James P. McAndrews; John A. Haug; Melvin Sharp

[57] ABSTRACT

A circuit breaker has two thin flat terminals embedded in an electrically insulating housing exposing respective broad flat sides of the terminals in spaced side-by-side relation to each other in a housing chamber. The circuit breaker has a thermostat metal member secured at one end to one exposed side of one terminal to mount the member extending along a chamber wall and has a contact at its opposite end to engage and disengage the other terminal to close and open a circuit in response to a selected current in the circuit. The contact comprises a material which erodes during repeated cycling of the circuit breaker. The thermostat metal member has a portion of reduced cross-sectional area adapted to burn out and separate the member into two sections to open the circuit if the contact welds or sticks to the other terminal. A stop on the housing intercepts movement of one of the member sections after burn-out to avoid shorting of the circuit. An abutment on the housing prevents reclosing of the circuit after the contact has eroded to a selected extent. In one embodiment, an electrical resistance heater of positive coefficient of resistivity having an improved electrical wire insulation is wound on the thermostat metal member and retains the circuit in an effective open circuit condition until the heater circuit is separately interrupted to reset the breaker.

22 Claims, 2 Drawing Sheets

CIRCUIT BREAKER

BACKGROUND OF THE INVENTION

The field of the invention is that of a circuit breaker for protecting an electrical circuit and the invention relates more particularly to small circuit breakers suited for automotive applications.

A known circuit breaker particularly adapted for use in a fuse-block-like component in automobiles for protecting various electrical circuits in the automobile has a pair of thin flat terminals embedded in a side wall of an electrically insulating housing so that respective broad flat sides of the terminals are exposed within the housing chamber in spaced side-by-side relation to each other. A thermostat metal member has one end welded to the exposed surface of one of the terminals to extend along the chamber wall and has a contact at its opposite end adapted to engage and disengage a mating contact on the broad exposed surface of the other terminal to open and close a circuit between the terminals in response to temperature changes in the member for protecting the circuit against current overloads. The circuit breaker structure is very compact and is adapted to carry heavy currents relative to its size making it very desirable for automotive circuit protection applications. However, the contact carried on the thermostat metal member preferably comprises a material such as a silver alloy to display low contact resistance. Such materials erode slowly over the service life of the device and can eventually stick or weld to the mating contact on the other terminal locking the circuit in closed position particularly after the silver alloy material has been substantially eroded away. It would be desirable if the circuit breaker could be adapted to open the circuit even in the event of contact welding to assure proper protection of the circuit. It would also be desirable to adapt the circuit heater to reduce contact wear and erosion.

BRIEF SUMMARY OF THE INVENTION

It is an object of the invention to provide a novel and improved circuit breaker; to provide such a circuit breaker which is particularly adapted for use in automotive applications; to provide such a circuit breaker which is adapted to open a circuit in the event of a selected current overload even if the breaker contacts weld or stick together; to provide such a circuit breaker which is of compact size having a high current capacity relative to its size; to provide such a circuit breaker which is automatically reset; to provide such a circuit breaker which is selectively reset; to provide such a circuit breaker which is inexpensive to manufacture; and provide such a circuit breaker which is rugged and reliable in use.

Briefly described, the novel and improved circuit breaker of the invention comprises a housing of electrical insulating material having walls forming a housing chamber. Two thin/flat electrically conductive terminals are embedded in the housing material in one wall of the chamber so that respective broad flat side surfaces of the terminals are exposed in spaced side-by-side relation to each other on that wall within the chamber. A thermostat metal member has an electrical contact of a low contact resistance silver or alloy or the like at one end and has its opposite end secured to the broad exposed side surface of one of the terminals within the chamber so that the member extends along the chamber wall to engage the contact with the broad exposed side surface of the other terminal, or with a mating contact on that surface of the other terminal, to close a circuit between the terminals. The thermostat metal member has a selected electrical resistance and preferably has a dished configuration which provides the member with selected thermal response characteristics such that the member develops a selected force to normally move the member contact with snap action out of engagement with the other terminal to open the circuit in a selected ambient temperature zone in response to occurrence of a selected overload current or the like in the circuit for protecting the circuit. In accordance with the invention, the thermostat metal member has a portion at a selected location between the terminals which is of relatively smaller cross-sectional area than other portions of the member intermediate the terminals and which is adapted to burn out and divide the member into two separate sections in the event the member contact welds to the other terminal or to a mating contact on the other terminal when the selected current occurs in the circuit.

In one embodiment of the invention, the thermostat metal member is a adapted to cool after opening of the circuit for automatically reclosing the circuit after a selected delay. In that way, the circuit breaker is automatically reset for protecting the circuit if the fault condition which has caused the overload current has been corrected or is adapted to cycle on and off until the fault condition is corrected.

In another preferred embodiment, an electrical resistance heater wire is wound on the thermostat metal member and is electrically connected between the terminals in parallel relation to the thermostat metal member. The heater has a selected electrical resistance much greater than that of the thermostat metal member so that when the thermostat metal member contact separates from the other terminal or when the member is burned out at its relatively smaller cross-sectional area, the breaker circuit is effectively in an open circuit condition while the heater is energized to heat the thermostat metal member and retain the circuit in that open circuit condition. Preferably the heater has a positive temperature coefficient of resistivity to be self-regulating at a select temperature within a narrow range during variations in voltage and ambient temperature likely to be encountered in automotive applications. In that way the compact heater structure adapted to carry heavy current achieves selective reset capability in the compact structure even during such wide variations in circuit voltage and ambient temperature.

Preferably the housing includes abutment means and stop means to keep the breaker circuit open if the breaker contacts erode to an excessive extent and to prevent shorting of the circuit by movement of one section of the thermostat metal after it has been divided into two sections by burn out of the member portion of relatively smaller cross-sectional area.

DESCRIPTION OF THE DRAWINGS

Other objects, advantages and details of the novel and improved circuit breaker of the invention appear in the following detailed description of preferred embodiments of the invention, the detailed description referring to the drawings in which.

DESCRIPTION OF THE PREFERRED EMBODIMENTS

Figure 1:
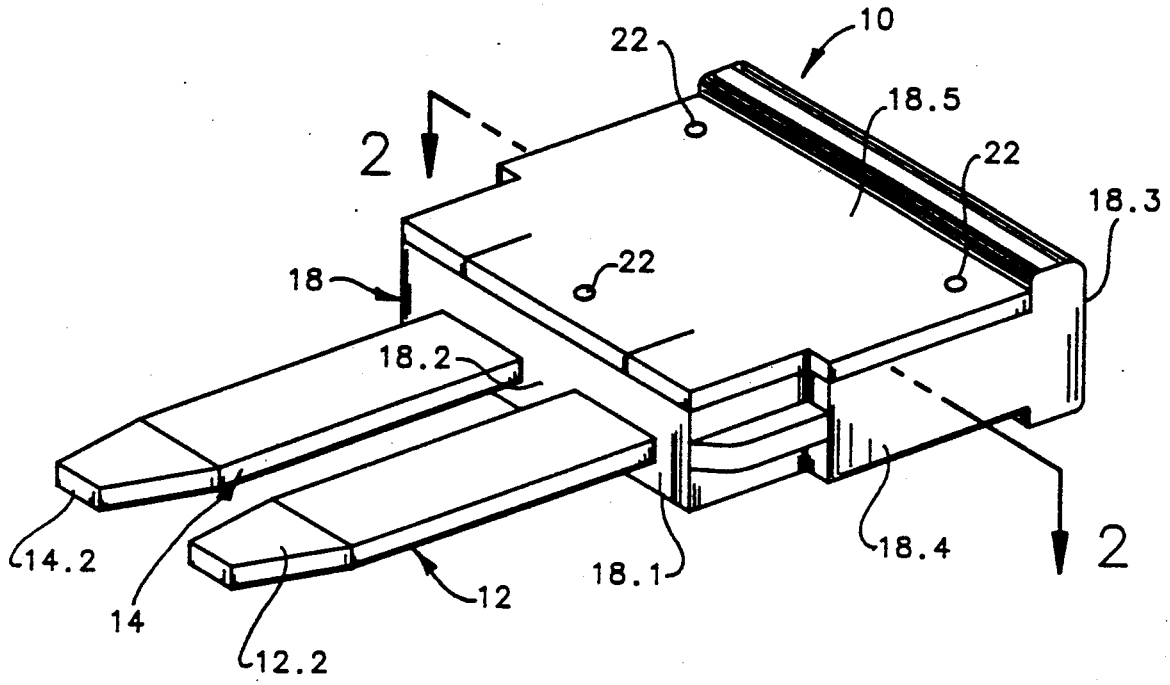
FIG. 1 is a perspective view of the circuit breaker of the invention.
Figure 2:
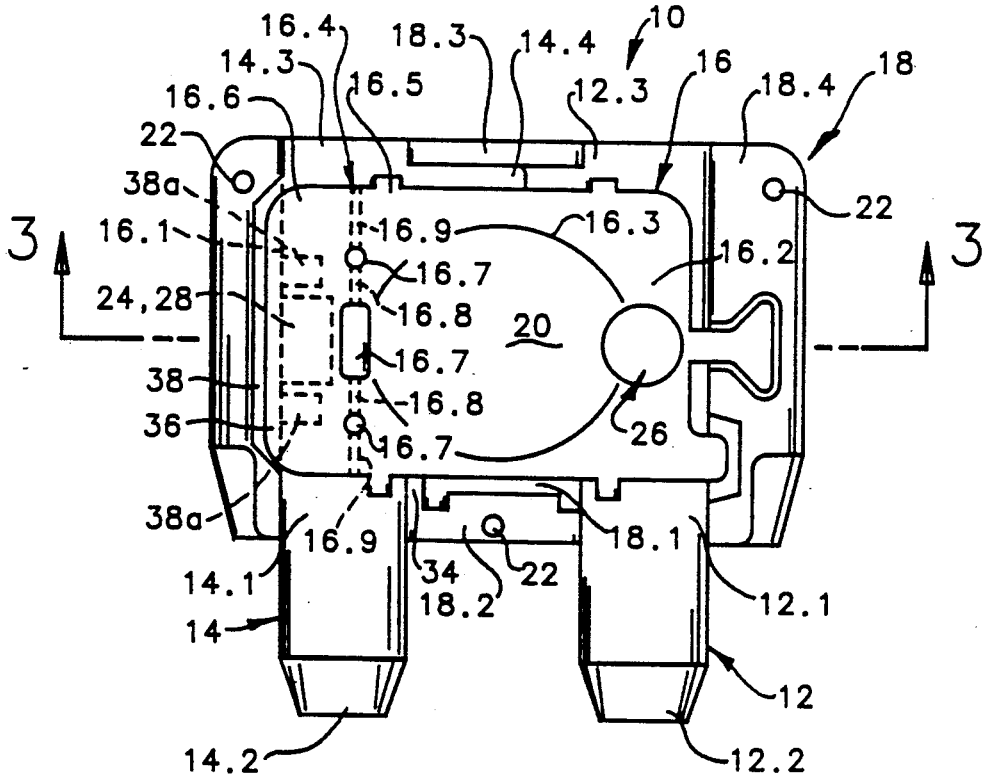
FIG. 2 is a section view along line 2—2 of FIG. 1.
Figure 3:
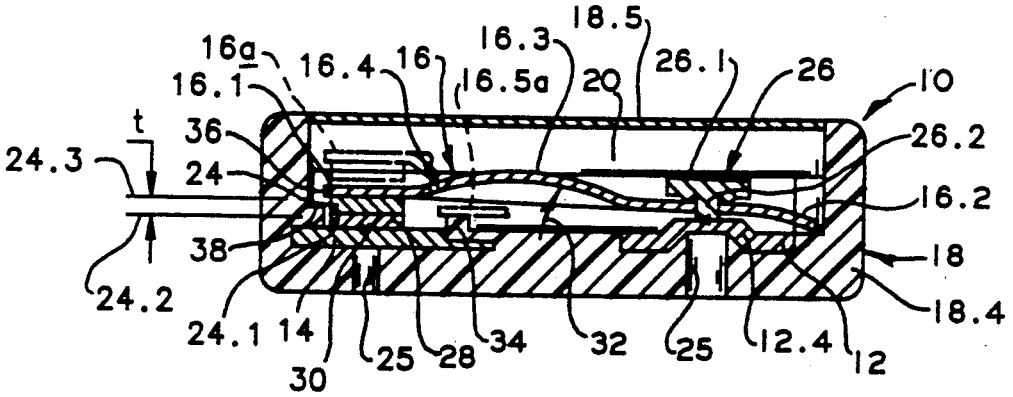
FIG. 3 is a section view along line 3-3 of FIG. 2.

Referring to the drawings, 10 in FIGS. 1-3 indicates the circuit breaker of the invention which includes two electrically conductive terminals 12 and 14 and a thermostat metal member 16. Preferably the terminals are wide and long but relatively thin and are embedded in a side wall 18.1 of an electrically insulating housing 18 of polytetrapthalate or the like so that respective broad flat surfaces 12.1, 14.1 of the terminals are exposed in a housing chamber 20 flush with the inner surface of the side wall 18.1. Preferably ends 12.2, 14.2 of the terminals extend through another side wall 18.2 to be connected in a circuit to be protected and, if desired, opposite terminal ends 12.3, 14.3 extend through a third wall 18.3 to receive circuit test probes or the like. The terminals are generally flat as shown but can include bends or the like to strengthen the terminals, to accommodate the terminals to a housing shape or to provide a projection weld or the like on the terminals. That terminal arrangement strengthens the housing wall and provides high current capacity in a compact way. The housing includes a base 18.4 and can include a separate cover 18.5 of the same material attached to the base by rivets 22 or by adhesives or the like, and in a preferred embodiment the cover comprises a formed aluminum unit having an aluminum oxide insulating coating on its principle surfaces to improve cover rupture resistance.

The thermostat metal member 16 comprises a conventional multilayer metal composite (only one layer being shown) having an electrical contact 24 secured on one end 16.1 of the member and having an opposite end 16.2 secured by a weld slug 26 or the like to one terminal 12 so the member extends along the housing side wall 18.1 and engages the contact 24 with the other terminal 14 to close the protected circuit between the terminals. That is, for example, the weld slug has a head 26.1 welded to the thermostat metal member and has a shank 26.2 welded to a projection weld 12.4 on the terminal 12. If desired, another contact 28 is secured to the other terminal by a weld 30 or the like to mate with the contact 24. Preferably housing openings 25 facilitate forming of such welds. The thermostat metal member has selected electrical resistance and thermal response characteristics to move in the direction of the arrow 32 to separate or disengage the contact 24 from the other terminal 14 to open the noted circuit in response to occurrence of a selected member temperature, thereby to protect the circuit against fault conditions such as excessive current in the circuit or excessive ambient temperatures or both resulting in overheating of the member. Preferably the member is adapted to cool with a selected delay after opening of the circuit to move in the opposite direction to reclose the circuit for automatically resetting the circuit breaker to again protect the circuit. The thermostat metal member can comprise a thermostat metal strip or the like to serve as a circuit breaker actuator. Preferably, however, the thermostat metal member has an original dished configuration portion 16.3 as shown in solid lines in FIG. 2 but is adapted to develop a selected force to move to an inverted dished configuration with snap action as indicated at **16*a*** to open the circuit in a selected ambient temperature zone in response to occurrence of a selected overload current or the like in the circuit. Preferably the dished thermostat member is also adapted to snap back to its original configuration to reclose the circuit when the member cools to a lower differential or resetting temperature after opening of the circuit.

The contact 24, and the contact 26 if used, are typically formed of any conventional electrical material according to the invention. Preferably, for example, the contact comprises a silver alloy material or the like to provide the contact with good electrical conductivity and low contact surface resistance. In that regard, it is known that electrical contacts of that type as used in circuit breakers provide the circuit breakers with excellent characteristics but are subject to some erosion and wear during repeated cycling of the circuit breaker to open and close a circuit over a long service life. Accordingly, the contacts are typically provided with a selected thickness t of the contact material for permitting the contact surface 24.1 engaged with other terminal to be eroded from a first surface level 24.2 to a second surface level 24.3 without tending to lose the desired contact conductivity and surface resistance characteristics or the like. It is also known that electrical contacts of the type described have some tendency to stick or weld to mating contacts or terminals to prevent the contact from being moved to open a circuit, particularly when a substantial overload current is present in the circuit or when the contact thickness has been substantially reduced or removed by contact surface erosion and the like.

In accordance with the invention, the thermostat metal member 16 is provided with one portion 16.4 at a selected location intermediate the terminals 12 and 14 which is of relatively much smaller cross-sectional area than the other portions of the member between the terminals so that a selected current directed through the member is concentrated with highest current density at the location of that relatively smaller cross-section. That smaller cross-sectional area is also selected and proportioned with respect to the selected current intended to be relied upon for opening the breaker circuit as above described so that, in the event that the contact 24 sticks or welds to the other terminal 14 or to the contact 26, so that the breaker circuit would fail to open in response to occurrence of the selected current in the circuit, the noted smaller cross-sectional area of the member is adapted to be burned out by the selected current at the location 16.4 to divide the member into separate sections 16.5 and 16.6 at that preferred location to open the circuit. Preferably the smaller cross-sectional area is located at the end of the member between the contact 24 and the dished configuration portion 16.3 of the member. Preferably for example, the thermostat metal member has three openings 16.7 therein which provide the member with the relatively smaller cross-sectional area of the member at the location of those openings than in any other part of the member intermediate the terminals 12 and 14. Preferably the central opening is relatively broader than the other openings and extends at least across the width of the contact 24. Preferably the spaces 16.8 between adjacent portions of the openings are slightly smaller than the portions 16.9 of the member adjacent the outer openings. In that arrangement, the highest current density initially appears in member portions 16.8 and tends to burn out those member portions first and then to rapidly extend the burnout fully the across the members as the initial burning out increases current density in remaining parts of the smaller cross-sectional area. The strong force developed in the thermostat metal member tends to separate the contacts with snap action during normal operation of the circuit breaker to limit contact wear and also serves to separate the member sections at the preferred location 16.4 during burnout of the member. In that way, the circuit breaker 10 is adapted to assure proper protection of the noted circuit even in the event the breaker contacts are subjected welding. In that regard, it will be understood that when the thermostat metal member is burned out at the location as indicated at 16.4, one section 16.5 of the member moves in the direction of the arrow 32 as the member section separates to open the circuit. That member section then tends to move back in the opposite direction as the member cools after opening of the circuit, the burned out portions of the member preventing any reengagement of the member sections for reclosing the breaker circuit. Preferably the housing includes an electrically insulating stop means such as the integral housing abutment 34 which is normally disposed beneath the thermostat metal member 16 adjacent the smaller cross-sectional area portion 16.4 of the member to intercept and position the member section 16.5 after member burnout has occurred to assure that movement of the member section does not result in any shorting of the breaker circuit.

In one preferred embodiment of the invention, the thermostat metal member end 16.1 slightly overhangs the contact 24 as indicated at 36 and an abutment 38 such as an integral abutment provided on the housing 18 is arranged beneath the member overhang so that, when the surface 24.1 of the contact is at its first level 24.2 as shown in FIG. 3, the member overhang 36 does not engage the abutment 38. However, when the contact surface has been eroded away to the second level 24.3, the member overhang is adapted to engage the abutment 38 to prevent subsequent reclosing of the circuit. In that way the circuit is provided with supplemental circuit opening protection particularly near the end of the normal life of the circuit breaker to open the circuit when contact surface erosion has reduced contact thickness to the point where contact welding becomes likely to occur without requiring thermostat member burnout. In that way, the abutment 38 and the thermal member burnout feature cooperate to provide circuit opening protection resulting from normal wear or circuit fault conditions. If desired, the abutment 38 extends around the contacts 24 and 26 so they normally mate through an opening in the abutment as indicated by broken lines 38*a* in FIG. 2 to assist in holding the thermostat metal member 16 in open circuit position after the contact surface 24.1 has eroded to the second level 24.3.

Figure 4:
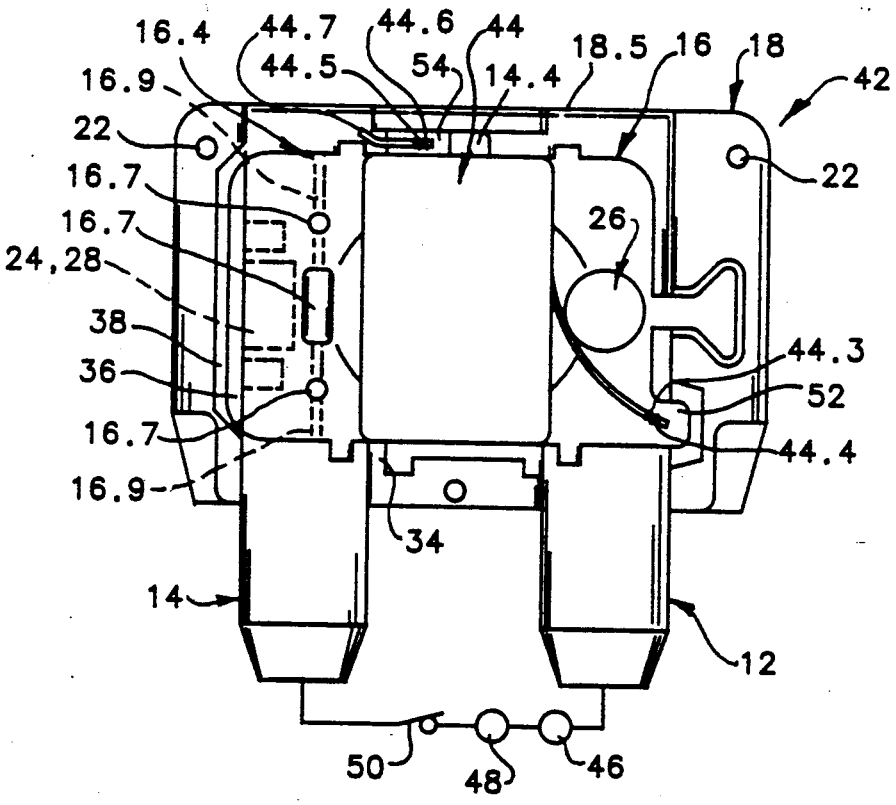
FIG. 4 is a section view similar to FIG. 2 illustrating an alternate embodiment of the invention.
Figure 5:
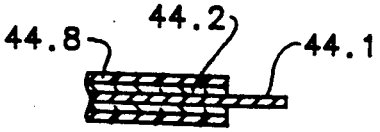
FIG. 5 is a section view along an axis of a wire used in a heater component of the circuit breaker of FIG. 4.

In another preferred embodiment of the invention as illustrated in FIGS. 4 and 5, wherein corresponding components are identified with corresponding reference numerals, the circuit breaker 42 is adapted to provide protection for a circuit and to require remote or selective resetting of the breaker before permitting reclosing of the circuit. In that regard, it will be appreciated that in automotive applications it is frequently desirable to have a circuit breaker automatically reset after tripping in response to occurrence of a fault condition in the circuit to restore operation of the circuit function for safety and convenience purposes as rapidly as possible. This is true even though such automatic resetting can result in cycling of the breaker resulting in undesirable breaker contact wear if the fault condition remains uncorrected. On the other hand, selective remote or even manual resetting of the circuit breaker can also be desirable in some automotive circuits particularly where safety is not of concern to save excessive wear of the breaker contacts. Preferably for example, the breaker 43 further includes an electrical resistance heater 44 which is electrically connected between the terminals 12 and 14 in parallel relation to the thermostat metal member 16 and which is disposed in heat-transfer relation to the thermostat metal member. Preferably the heater has a relatively much greater electrical resistance than the thermostat metal member so that when the contact 24 is separated from the terminal 14 to open the circuit the resistance of the heater is so high that the circuit is effectively in open circuit condition. However, the heater 44 continues to be energized to transfer heat to the thermostat metal member to retain the member in the open circuit position until energization of the heater is otherwise selectively interrupted by remote means or the like. Preferably for example where the circuit breaker is connected in an automotive circuit including a nominally 14 volt DC automotive power source 46 and an automotive load 48 and where a manually operated switch 50 such as a vehicle ignition switch or the like is arranged to selectively interrupt the circuit, the thermostat metal member is arranged to have an electrical resistance of about 2 milliohms and to open the breaker circuit in response to a 10 ampere current in the circuit at a selected ambient temperature. The heater 44 is provided with about 50 ohms resistance so that, when the circuit is closed there is a very small voltage drop across the heater and the heater generates very little heat. Accordingly, the actuating temperature of the thermostat metal member is little affected by the heater even during variations in automotive voltage level or the like and any opening of the circuit by the member is primarily in response to an increase in current in the circuit or increase in the ambient temperature around the breaker in an intended manner. However, after opening of the breaker circuit, substantially the full voltage of the power supply is applied across the heater so that the heater generates a substantial amount of heat sufficient to retain the circuit breaker in an effective open circuit condition until the circuit is selectively interrupted by manual opening of the switch 50 for example which permits the thermostat metal member to cool to allow the breaker to reset.

In a preferred embodiment for example, the circuit breaker comprises a metal wire 44.1 of a metal material such as nickel, tungsten, a nickel-iron alloy commercially available under the trade name BALCO (a registered trademark of Carpenter Technology Corporation) or other nickel or nickel-iron alloys or the like having a positive temperature coefficient of resistivity of at least about 0.0040 ohms per ohm per degree C. in a temperature range up to about 450° C. The thermostat metal member is provided with an integral tang 52 and one end 44.3 of the heater wire 44 is welded or otherwise secured to the tang as shown at 44.4 in FIG. 5. The wire is wound around the thermostat metal member spaced from the reduced cross-section portion 16.4 in a plurality of convolutions or the like to provide the heater with a desired resistance relative to the member 16 as noted above and to provide the heater with the desired heat-transfer capability. The opposite end 44.5 of the heater wire is welded or otherwise electrically connected at 44.6 to a tab 54, and that tab is welded or otherwise connected to a pad 14.4 provided on the other terminal, thereby to connect the heater between the terminals. In that arrangement, the heater has little effect in transferring heat to the thermostat metal member when the member is in closed circuit position even though the ambient temperature encountered in automotive applications varies in the range from −40° to +85° C., and even though the voltage output from automotive power supplies can typically vary by as much as from +9 to +16 volts DC. However, when the member moves to its open circuit position in response to a selected overload current such as above described to open the circuit, the heater provides sufficient heat under the varying voltage and ambient temperature conditions as noted and is compactly disposed in such excellent heat-transfer relation to the thermostat metal member as to retain the member in its open circuit position until the breaker is reset by opening of the switch 50. In that arrangement, the heater is also adapted to be self-regulating and to stabilize at a safe temperature such as will not injure the thermostat member or other breaker components even as the voltage and ambient temperature vary as noted above and even if the applied voltage should be as high as +24 DC as can sometimes occur by error during jump-starting of an automotive engine. That is, where the applied voltage and ambient temperature are high in the ranges noted so they might be expected to increase heater temperature to increase to the level where it could cause damage to the various circuit breaker components, the described degree of positive temperature coefficient of resistivity means that heater resistance increases to a corresponding degree to reduce heater current and maintain the heater at a safe temperature within a narrow range. On the other hand where the applied voltage and ambient temperature vary so the heater might be expected to reduce its temperature and the heat output from the heater wire, the resistance of the heater is adapted to decrease to a corresponding degree to increase heater current and maintain the heater at a safe temperature within the narrow range which is sufficient to maintain the thermostat member in open circuit position. In this way the desired selective reset capability is achieved in the compact, high current structure as described while also being able to handle the wide variations in voltage and ambient temperature encountered in automobile applications.

In one preferred embodiment where the fiberglass insulation 44.2 is utilized to be adapted to withstand heater wire temperatures up to 400° C. or the like as can be encountered in use of the described circuit breaker in automotive applications, the wire insulation is preferably coated with and/or impregnated with a binder or coating material 44.8 such as borosiloxane polymer, silicone varnishes with selected additives adapted to stabilize the varnishes at temperatures up 400° C., and thermoplastics which can be applied to the fiberglass in liquid form and cured in situ on the fiberglass, the coating material being selected to be stable to retain the fiberglass in place without fraying at the ends of the wire at temperatures up to 400° C. free of running, dripping or outgassing from the coating.

It should be understood that although particular embodiments of the invention has been described by way of illustrating the invention, the invention includes all modifications and equivalents of the disclosed embodiments falling within the scope of the appended claims.

We claim:

1. A circuit breaker comprising two terminals, and a thermostat metal member having a contact at one end, the member having an opposite end secured to one of the terminals to mount the member with the contact engaging the other terminal to close a circuit and to be movable in response to occurrence of a selected current in the member which generates a member temperature to open the circuit, the member having a portion intermediate the terminals of relatively smaller cross-sectional area than other portions of the member intermediate the terminals, the relatively smaller cross-sectional area being selected to be burned out by said selected current in the circuit to open the circuit in the event the contact welds to the other terminal.

2. A circuit breaker comprising two terminals to be connected in a circuit, and a thermostat metal member having an electrical contact at one end of the member, the member having an opposite end welded to one of the terminals to mount the member with the contact engaging the other terminal to close the circuit between the terminals, the member having selected electrical resistance and having a dished configuration providing the member with thermal response characteristics to develop a selected force to normally move with snap action to an inverted dished configuration to separate the contact from the other terminal to open the circuit in a selected ambient temperature zone in response to a selected electrical current in the circuit for protecting the circuit, the member having a portion at a selected location intermediate the terminals of relatively smaller cross-sectional area than other portions of the member intermediate the terminals, said smaller cross-sectional area being selected to be burned out by the occurrence of said selected current in the circuit to separate the member into sections at the selected location to open the circuit in the event the contact welds to the other terminal.

3. A circuit breaker comprising two terminals to be connected in a circuit, and a thermostat metal member having an electrical contact at one end of the member, the member having an opposite end welded to one of the terminals to mount the member with the contact engaging the other terminal to close the circuit between the terminals, the member having selected electrical resistance and having a dished configuration providing the member with thermal response characteristics to develop a selected force to normally move with snap action to an inverted dished configuration to separate the contact from the other terminal to open the circuit in a selected ambient temperature zone in response to a selected current in the circuit for protecting the circuit, the member having a portion at a selected location intermediate the terminals of relatively smaller cross-sectional area than other portions of the member intermediate the terminals to be burned out by the selected current in the circuit to separate the member into sections at the selected location to open the circuit in the event the contact welds to the other terminal, wherein the thermostat metal member normally moves in a first direction to open the circuit and cools to move in an opposite direction after opening of the circuit to reclose the circuit, one section of the member attached to the one terminal separates from the other member section and moves in the first direction in response to burn out of the member at the relatively smaller cross-sectional area to open the circuit and cools to move in the opposite direction after opening of the circuit, and an electrically insulating stop is disposed to intercept movement of the separated one section of the member in the opposite direction to retain the one member section in an open circuit condition.

4. A circuit breaker comprising two terminals to be connected in a circuit, and a thermostat metal member having an electrical contact at one end of the member, the member having an opposite end welded to one of the terminals to mount the member with the contact engaging the other terminal to close the circuit between the terminals, the member having selected electrical resistance and having a dished configuration providing the member with thermal response characteristics to develop a selected force to normally move with snap action to an inverted dished configuration to separate the contact from the other terminal to open the circuit in a selected ambient temperature zone in response to a selected current in the circuit for protecting the circuit, the member having a portion at a selected location intermediate the terminals of relatively smaller cross-sectional area than other portions of the member intermediate the terminals to be burned out by the selected current in the circuit to separate the member into sections at the selected location to open the circuit in the event the contact welds to the other terminal, wherein the contact has a surface for engaging the other terminals to close the circuit, the contact has a selected thickness of electrically conducting material forming the surface which is erodible to reduce the material thickness and change the contact surface from a first level to a second level during repeated cycling of the circuit breaker to open and close the circuit, and an additional stop is disposed to intercept movement of the member to prevent closing of the circuit when the contact material has been eroded to change the contact surface to the second level.

5. A circuit breaker comprising two terminals to be connected in a circuit, and a thermostat metal member having an electrical contact at one end of the member, the member having an opposite end welded to one of the terminals to mount the member with the contact engaging the other terminal to close the circuit between the terminals, the member having selected electrical resistance and having a dished configuration providing the member with thermal response characteristics to develop a selected force to normally move with snap action to an inverted dished configuration to separate the contact from the other terminal to open the circuit in a selected ambient temperature zone in response to a selected current in the circuit for protecting the circuit, the member having a portion at a selected location intermediate the terminals of relatively smaller cross-sectional area than other portions of the member intermediate the terminals to be burned out by the selected current in the circuit to separate the member into sections at the selected location to open the circuit in the event the contact welds to the other terminal, the circuit breaker having an electrical resistance heater electrically connected between the terminals to be electrically energized in parallel relation with the thermostat metal member, the heater having selected electrical resistance properties to provide a substantially open circuit condition between the terminals for protecting the circuit when the thermostat metal member has moved to open the circuit while heating the member to maintain the substantially open circuit condition until energization of the heater is otherwise interrupted to reset the circuit breaker, the electrical resistance heater material having a selected positive temperature coefficient of resistivity of at least about 0.0040 ohms per ohm per degree C. in the temperature range up to about 400°60 C. to be self-regulating to stabilize at a safe temperature within a selected range to maintain the substantially open circuit condition in a circuit in an automobile during variation in ambient temperature of the circuit breaker in the range from −40 to +85° C. and variation in circuit voltage in the range from +9 to +16 volts DC likely to be encountered in an automobile environment.

6. A circuit breaker according to claim 5 wherein the heater stabilizes at a safe temperature in the selected range during variation in a circuit voltage up to 24 volts DC.

7. A circuit breaker comprising a housing of electrical insulating material having walls forming a chamber, two thin flat terminals embedded in one wall of the housing exposing one broad flat side surface of each terminal within the chamber in spaced side-by-side relation to each other facing in the same direction into the chamber, each terminal having a portion extending through another wall of the chamber to be connected in a circuit, a thermostat metal member having an electrical contact at one end of the member, the member having an opposite end welded to the broad flat surface of one terminal exposed in the chamber to mount the member extending along the one chamber wall with the contact engaging the broad flat surface of the other terminal exposed in the chamber to close the circuit between the terminals, the member having selected electrical resistance and having a dished configuration providing the member with thermal response characteristics to develop a selected force to normally move with snap action to an inverted dished configuration to separate the contact from the other terminal to open the circuit in a selected ambient temperature zone in response to a selected electrical current in the member for protecting the circuit, the member having a portion at a selected location intermediate the terminals of relatively smaller cross-sectional area than other portions of the member intermediate the terminals to be burned out by the selected current in the circuit to separate the member into sections at the selected location to open the circuit in the event the contact welds to the other terminal.

8. A circuit breaker according to claim 7 wherein the thermostat metal member normally moves in a first direction to open the circuit and cools to move in an opposite direction after opening of the circuit to reclose the circuit, one section of the member attached to the one terminal separates from the other member section and moves in the first direction in response to burn out of the member at the relatively smaller cross-sectional area to open the circuit and cools to move in the opposite direction after opening of the circuit, and an electrically insulating stop is disposed on the one housing wall within the chamber to intercept movement of the separated one section of the member in the opposite direction to retain the one member section in an open circuit condition.

9. A circuit breaker according to claim 8 wherein the contact has a surface for engaging the other terminal to close the circuit, the contact has a selected thickness of electrically conducting material forming the surface which is erodible to reduce the material thickness and change the contact surface from a first level to a second level during repeated cycling of the circuit breaker to open and close the circuit, and an abutment is disposed on the housing wall within the chamber to intercept movement of the member to prevent closing of the circuit when the contact material has been eroded to change the contact surface to the second level.

10. A circuit breaker according to claim 9 having an additional contact mounted on the broad flat surface of the other terminal exposed within the chamber for mating with the contact on the thermostat metal member.

11. A circuit breaker according to claim 10 wherein the abutment comprises a boss on the housing extending partly around the additional contact to engage the one end of the thermostat metal member adjacent the first-named contact to prevent closing of the circuit when the first-named contact surface is eroded to the second surface level.

12. A circuit breaker according to claim 7 having an electrical resistance heater electrically connected between the terminals to be electrically energized in parallel relation with the thermostat metal member, the heater having selected electrical resistance properties to provide a substantially open circuit condition between the terminals for protecting the circuit when the thermostat metal member has moved to open the circuit while heating the member to maintain the substantially open circuit condition until energization of the heater is otherwise interrupted to reset the circuit breaker.

13. A circuit breaker according to claim 12 wherein the electrical resistance heater has much greater electrical resistance than the thermostat metal member to provide a relatively lower voltage drop across the heater when the contact is engaged with the other terminal to close the circuit and to have a much greater voltage drop across the heater when the contact is separated from the other terminal for heating the member to maintain the substantially open circuit condition until energization of the heater is otherwise interrupted to reset the circuit breaker, the heater comprising a wire of metal material having a selected positive temperature coefficient of resistivity of at least about 0.0040 ohms per ohm per degree C. to be self-regulating to stabilize at a safe temperature within a selected range in a circuit in an automobile during variation in ambient temperature of the circuit breaker in the range from −40° to +85° C. and variations in circuit voltage in the range from +9° to +16 volts DC likely to be encountered in an automobile environment.

14. A circuit breaker according to claim 13 wherein the heater stabilizes at a safe temperature in the selected range during variation in circuit voltage up to 24 volts DC.

15. A circuit breaker according to claim 13 wherein the heater comprises a length of wire wound in electrically insulated relation around the thermostat metal member, the member has a tang at the other end of the member electrically connected to one end of the wire, a metal boss is electrically connected to an opposite end of the wire, and the boss is welded to the other terminal, the wire having a length permitting movement of the thermostat metal to open and close the circuit.

16. A circuit breaker according to claim 15 wherein the heater wire is wound around a portion of the thermostat metal member spaced from the member portion of the relatively small cross-sectional area to prevent heater burnout during burn out of the member.

17. A circuit breaker according to claim 15 wherein the metal wire has a multifiber fiberglass insulation formed on the wire for electrically insulating convolutions of the wire from each other and from the member, and an organic binder material stable at temperatures up to 400° C. on the fiberglass preventing fraying of the fiberglass, thereby to permit use of the insulation in the circuit breaker with heater temperatures up to 400° C. free of running, dripping or outgassing from the insulation.

18. A circuit breaker according to claim 17 wherein the binder is selected from the group consisting of borosiloxane polymer, silicone varnishes with additives stabilizing the varnishes at 400° C., and thermoplastics applied to the fiberglass in a liquid state and cured in situ on the fiberglass.

19. A circuit breaker comprising two terminals to be connected in a circuit, a thermostat metal member having an electrical contact at one end of the member, the member having an opposite end secured to one of the terminals to mount the member with the contact engaging the other terminal to close a circuit between the terminals, the member having selected electrical resistance and having a dished configuration providing the member with thermal response characteristics to move with snap action to an inverted dished configuration to separate the contact from the other terminal to open the circuit in a selected ambient temperature zone in response to a selected current in the circuit for protecting the circuit, and an electrical resistance heater wire electrically connected between the terminals to be electrically energized in parallel relation with the thermostat metal member, the heater wire having selected electrical resistance properties to provide a substantially open circuit condition between the terminals for protecting the circuit when the thermostat metal member has moved to separate the contact from the other terminal while heating the member to maintain the substantially open circuit condition until energization of the heater is otherwise interrupted to reset the circuit breaker, the electrical resistance heater wire being wound on the thermostat metal member to be compactly disposed in close heat-transfer relation to the thermostat metal member while permitting snap-acting movement of the member in the compact heater structure and having a selected positive temperature coefficient of resistivity to be self-regulating to stabilize at a safe temperature within a selected range to maintain the substantially open circuit condition in a circuit in an automobile during variation in ambient temperature of the circuit breaker in the range from −40° to +85° C. and variation in circuit voltage in the range from +9 to +16 volts DC likely to be encountered in an automobile environment.

20. A circuit breaker comprising two terminals to be connected in a circuit, a thermostat metal member having an electrical contact at one end of the member, the member having an opposite end secured to one of the terminals to mount the member with the contact engaging the other terminal to close a circuit between the terminals, the member having selected electrical resistance and having a dished configuration providing the member with thermal response characteristics to move with snap action to an inverted dished configuration to separate the contact from the other terminal to open the circuit in a selected ambient temperature zone in response to a selected current in the circuit for protecting the circuit, and an electrical resistance heater wire electrically connected between the terminals to be electrically energized in parallel relation with the thermostat metal member, the heater wire having selected electrical resistance properties to provide a substantially open circuit condition between the terminals for protecting the circuit when the thermostat metal member has moved to separate the contact from the other terminal while heating the member to maintain the substantially open circuit condition until energization of the heater is otherwise interrupted to reset the circuit breaker, the electrical resistance heater wire being wound on the thermostat metal member to be compactly disposed in close heat-transfer relation to the thermostat metal member while permitting snap-acting movement of the member in the compact heater structure and having a selected positive temperature coefficient of resistivity of at least about 0.0040 ohms per degree C. in the temperature range up to about 400° C. to be self-regulating to stabilize at a safe temperature within a selected range to maintain the substantially open circuit condition in a circuit in an automobile during variation in ambient temperature of the circuit breaker in the range from −40° to +85° C. and variation in circuit voltage in the range from +9 to +16 volts DC likely to be encountered in an automobile environment.

21. A circuit breaker according to claim 20 wherein the heater stabilizes at a safe temperature in the selected range during variation in circuit voltage up to 24 volts DC.

22. A circuit breaker comprising a housing of electrical insulating material having walls forming a chamber, two thin flat terminals embedded in one wall of the housing exposing one broad flat side surface of each terminal within the chamber in spaced side-by-side relation to each other facing in the same direction into the chamber, each terminal having a portion extending through another wall of the chamber to be connected in a circuit, a thermostat metal member having an electrical contact at one end of the member,.the member having an opposite end welded to the broad flat surface of one terminal exposed in the chamber to mount the member extending along the one chamber wall with the contact engaging the broad flat surface of the other terminal exposed in the chamber to close the circuit between the terminals, the member having selected electrical resistance and having a dished configuration providing the member with thermal response characteristics to develop a selected force to normally move with snap action to an inverted dished configuration to separate the contact from the other terminal to open the circuit in a selected ambient temperature zone in response to a selected electrical current in the member for protecting the circuit, and an electrical resistance heater wire electrically connected between the terminals to be electrically energized in parallel relation with the thermostat metal member, the heater wire having selected electrical resistance properties to provide a substantially open circuit condition between the terminals for protecting the circuit when the thermostat metal member has moved to separate the contact from the other terminal while heating the member to maintain the substantially open circuit condition until energization of the heater is otherwise interrupted to reset the circuit breaker, the electrical resistance heater wire being wound on the thermostat metal member to be compactly disposed in close heat-transfer relation to the thermostat metal member while permitting snap-acting movement of the member in the compact heater structure and having a selected positive temperature coefficient of resistivity of at least about 0.0040 ohms per degree C. in the temperature range up to about 400° C. to be self-regulating to stabilize at a safe temperature within a selected range to maintain the substantially open circuit condition in a circuit in an automobile during variation in ambient temperature of the circuit breaker in the range from −40° to +85° C. and variation in circuit voltage in the range from +9 to +16 volts DC likely to be encountered in an automobile environment.

* * * * *